US007452596B2

(12) United States Patent
Adachi

(10) Patent No.: US 7,452,596 B2
(45) Date of Patent: Nov. 18, 2008

(54) POLYVINYL CHLORIDE-BASED FIBER WITH EXCELLENT STYLE CHANGEABILITY

(75) Inventor: Masayuki Adachi, Hyogo (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 11/885,600

(22) PCT Filed: Feb. 23, 2006

(86) PCT No.: PCT/JP2006/303244

§ 371 (c)(1),
(2), (4) Date: Aug. 31, 2007

(87) PCT Pub. No.: WO2006/093009

PCT Pub. Date: Sep. 8, 2006

(65) Prior Publication Data

US 2008/0139705 A1 Jun. 12, 2008

(30) Foreign Application Priority Data

Mar. 4, 2005 (JP) ..... 2005-060763

(51) Int. Cl.
*D02G 3/00* (2006.01)

(52) U.S. Cl. ..... 428/364; 428/394; 525/239

(58) Field of Classification Search ..... 428/364, 428/394; 525/239; 524/364
See application file for complete search history.

(56) References Cited

U.S. PATENT DOCUMENTS 3,183,201 A * 5/1965 Jiro et al. ..... 524/364
3,372,219 A * 3/1968 Gord ..... 525/239
3,419,891 A * 12/1968 Cornell ..... 523/115
4,469,818 A * 9/1984 Grundmann ..... 521/64
4,473,608 A * 9/1984 Grundmann ..... 428/68
4,508,778 A * 4/1985 Achard ..... 428/364
4,707,319 A * 11/1987 Achard et al. ..... 264/168
6,673,442 B2 * 1/2004 Johnson et al. ..... 428/364
2008/0139705 A1 * 6/2008 Adachi ..... 524/80

FOREIGN PATENT DOCUMENTS

| | | |
|---|---|---|
| JP | 48-6940 | 2/1973 |
| JP | 48-82118 | 11/1973 |
| JP | 50-135323 | 10/1975 |
| JP | 55-51802 | 4/1980 |
| JP | 55-76102 | 6/1980 |
| JP | 56-63006 | 5/1981 |
| JP | 11-50330 | 2/1999 |

* cited by examiner

*Primary Examiner*—N Edwards
(74) *Attorney, Agent, or Firm*—Hamre, Schuman, Mueller & Larson, P.C.

(57) ABSTRACT

A polyvinyl chloride-based fiber of the present invention is a fiber formed with a vinyl chloride resin composition that comprises (a) 100 parts by weight of vinyl chloride resin, and (b) 0.2 to 20 parts by weight of crosslinked vinyl chloride resin in which a weight fraction of constituents that are insoluble in tetrahydrofuran is 18 to 45% and a viscosity average degree of polymerization of constituents that are soluble in tetrahydrofuran is 500 to 1800, in which a cross-sectional shape of the fiber comprises a combination of at least two of circles, ellipses, and parabolas. When this fiber is used as artificial hair, it is possible to provide style changeability without impairing matte properties and touch of the vinyl chloride-based fiber. Furthermore, the fiber of the present invention can be produced stably by melt-spinning, and thus an industrial advantage also is provided.

20 Claims, 4 Drawing Sheets

POLYVINYL CHLORIDE-BASED FIBER WITH EXCELLENT STYLE CHANGEABILITY

TECHNICAL FIELD

The present invention relates to a polyvinyl chloride-based fiber that is excellent in touch, matte properties, and style changeability.

BACKGROUND ART

Polyvinyl chloride-based fibers produced by extrusion-spinning vinyl chloride resins are excellent in, for example, strength, elongation, curl retention, matte properties, and touch, and thus they are used widely as fibers for artificial hair such as hair decoration. Patent Document 1 has proposed a polyvinyl chloride-based fiber produced from a composition that contains a vinyl chloride resin and a matting agent such as a crosslinked vinyl chloride resin. It has been disclosed that this fiber is excellent in touch and appearance (matte properties). However, this fiber is not sufficiently provided with style changeability (properties with which wigs and the like can be changed into various styles with, for example, a brush or a comb: hereinafter, referred to as "style changeability").

Patent Document 2 has proposed a fiber for artificial hair, in which a surface of the fiber has projected lines in the axial direction of the fiber and the projected lines further have projections and indentations. It has been disclosed that artificial hair products such as wigs using this fiber are excellent in style changeability. However, in Patent Document 2, there is no specific disclosure of a vinyl chloride resin. It should be noted that JP S5-76102A has disclosed a fiber in which the fiber cross section has protrusions in the radial direction. This patent document also has disclosed that this fiber preferably can be used for wigs. However, in this patent document, there is no statement regarding a crosslinked vinyl chloride resin or style changeability.

Patent Document 1: JP H11-50330A

Patent Document 2: JP S56-63006A

DISCLOSURE OF INVENTION

Problem to be Solved by Invention

The present invention is to provide a polyvinyl chloride-based fiber containing a crosslinked vinyl chloride resin, in which style changeability has been improved while matte properties, touch, and other characteristics of a fiber produced from a vinyl chloride resin containing a crosslinked vinyl chloride resin are kept.

Means for Solving Problem

The present inventors had conducted an in-depth study in order to solve the above-described problem, and found that the above-described object can be achieved by controlling the fiber surface roughness and the cross-sectional shape of a polyvinyl chloride-based fiber, and thus the present invention has been achieved.

More specifically, the present invention is directed to a polyvinyl chloride-based fiber below.

(1) A polyvinyl chloride-based fiber, comprising a vinyl chloride resin composition that comprises (a) 100 parts by weight of vinyl chloride resin, and (b) 0.2 to 20 parts by weight of crosslinked vinyl chloride resin in which a weight fraction of constituents that are insoluble in tetrahydrofuran is 18 to 45% and a viscosity average degree of polymerization of constituents that are soluble in tetrahydrofuran is 500 to 1800, wherein a cross-sectional shape of the fiber comprises a combination of at least two of circles.

(2) The polyvinyl chloride-based fiber according to (1), wherein a cross-sectional shape of the fiber comprises a combination of at least three of circles, ellipses, and parabolas.

(3) The polyvinyl chloride-based fiber according to (1), wherein a cross-sectional shape of the fiber comprises a combination of at least four of circles, ellipses, and parabolas.

(4) The polyvinyl chloride-based fiber according to (1), wherein a ratio B/A between a minor diameter (A) and a major diameter (B) of a cross-sectional shape of the fiber is 1.2 to 2.0.

(5) The polyvinyl chloride-based fiber according to (1), wherein a surface of the fiber has protrusions, and an average longitudinal length of the protrusions is 1 μm to 30 μm.

(6) The polyvinyl chloride-based fiber according to any one of (1) to (5), wherein the cross-sectional shape of the fiber further comprises an ellipses or a parabola in addition to the combination.

EFFECT OF INVENTION

According to the polyvinyl chloride-based fiber of the present invention, it is possible to obtain a polyvinyl chloride-based fiber in which style changeability has been improved while curl retention, matte properties, touch, and other characteristics of a conventional vinyl chloride-based fiber are kept.

BEST MODE FOR CARRYING OUT THE INVENTION

Figure 1:
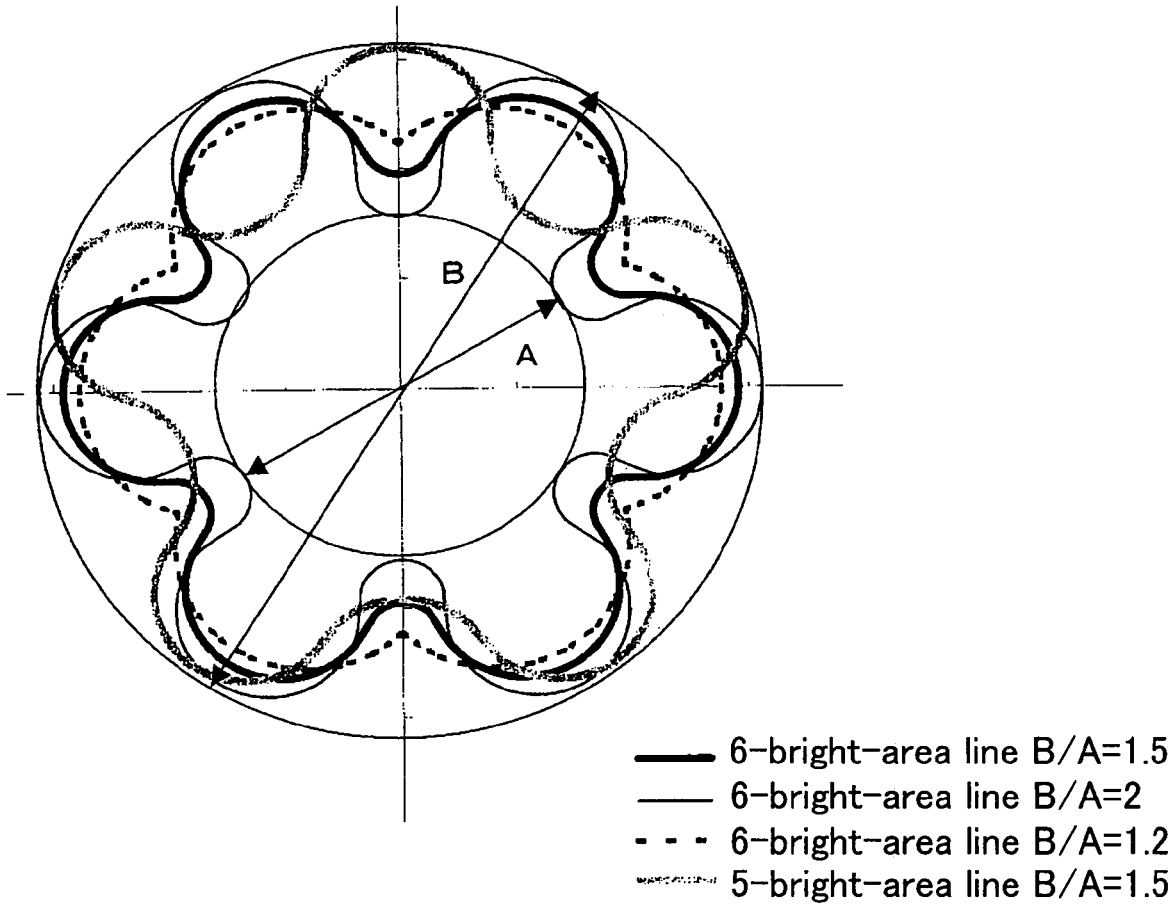
FIG. 1 is a cross-sectional view of a fiber with a six-leaved cross section and a five-leaved cross section (showing a minor diameter (A) and a major diameter (B) of the cross-sectional shape).

A vinyl chloride resin (a) used in the present invention refers to homopolymer resins that are conventionally known vinyl chloride homopolymers, or conventionally known various copolymer resins, and there is no specific limitation on this vinyl chloride resin (a). Representative examples of the copolymer resins include: copolymer resins of vinyl chloride and vinyl esters, such as a vinyl chloride/vinyl acetate copolymer resin, and a vinyl chloride/vinyl propionate copolymer resin; copolymer resins of vinyl chloride and acrylic esters, such as a vinyl chloride/butyl acrylate copolymer resin, and a vinyl chloride/2-ethylhexyl acrylate copolymer resin; copolymer resins of vinyl chloride and olefins, such as a vinyl chloride/ethylene copolymer resin, and a vinyl chloride/propylene copolymer resin; and a vinyl chloride/acrylonitrile copolymer resin. Examples of a preferable vinyl chloride resin include a homopolymer resin that is a vinyl chloride homopolymer, a vinyl chloride/ethylene copolymer resin, and a vinyl chloride/vinyl acetate copolymer resin. In the copolymer resins, there is no specific limitation on comonomer content, and it can be determined according to moldability into fibers, fiber properties, and the like.

The viscosity average degree of polymerization of the vinyl chloride resin used in the present invention preferably is 450 or more, in order to achieve sufficient strength and sufficient thermal resistance as a fiber. Furthermore, in order to produce a fiber safely under proper nozzle pressure, the degree of polymerization preferably is 1800 or less. In order to achieve moldability and fiber properties, in a case where a vinyl chloride homopolymer resin is used, the viscosity average degree of polymerization particularly preferably is 650 to 1450. In a case where a copolymer is used, a particularly preferable viscosity average degree of polymerization is 1000 to 1700, although it depends on the comonomer content. It should be noted that the viscosity average degree of polymerization is calculated following JIS-K6721, by dissolving 200 mg of resin in 50 ml of nitrobenzene, placing this polymer solution in a 30° C. constant temperature bath, and measuring the specific viscosity using an Ubbelohde viscometer.

The vinyl chloride resin used in the present invention can be produced, for example, by emulsion polymerization, block polymerization, or suspension polymerization. In view of, for example, initial coloring of the fiber, a polymer produced by suspension polymerization is preferable.

As the vinyl chloride resin used in the present invention, a chlorinated vinyl chloride resin also may be used. It is preferable to use a chlorinated vinyl chloride resin in which a vinyl chloride resin is used as a raw material, and chlorine is reacted therewith, thereby increasing the chlorine content to 58 to 72%. When a resin is chlorinated, the thermal resistance of the resin is improved, and thus using a chlorinated vinyl chloride resin provides an effect of reducing thermal contraction of a fiber. The viscosity average degree of polymerization of the chlorinated vinyl chloride resin (the viscosity average degree of polymerization of the vinyl chloride resin serving as a raw material) preferably is 300 to 1100. If the viscosity average degree of polymerization is less than 300, then the effect of lowering the thermal contraction ratio of a fiber becomes small, and thus a fiber having a comparatively high contraction ratio is obtained. If the viscosity average degree of polymerization is more than 1100, then the melt viscosity becomes high, and thus the nozzle pressure during spinning becomes high, so that performing a safe operation tends to be difficult. The viscosity average degree of polymerization particularly preferably is 500 to 900. Furthermore, if the chlorine content is less than 58%, then the effect of lowering the thermal contraction ratio of a fiber becomes small. If the chlorine content is more than 72%, then the melt viscosity becomes high, and thus performing stable operation tends to be difficult. Thus, such chlorine contents are not preferable.

In view of yarn breaking during spinning or coloration of a yarn due to heat, using the chlorinated vinyl chloride resin in combination with a vinyl chloride resin is more preferable than using it alone. The chlorinated vinyl chloride resin preferably is mixed in a ratio of 0 to 40 wt % with respect to 100 to 60 wt % of the vinyl chloride resin. If the chlorinated vinyl chloride resin is more than 40 wt %, then yarn breaking occurs more during spinning.

In the present invention, a crosslinked vinyl chloride resin (b) is used in which the weight fraction of constituents that are insoluble in tetrahydrofuran (gel fraction) is 18 to 45 wt %, and the viscosity average degree of polymerization of constituents that are soluble in tetrahydrofuran is 500 to 1800. If the weight fraction of constituents that are insoluble in tetrahydrofuran is less than 18 wt %, then the matte properties of the fiber tend to be insufficient, and the style changeability also tends to be poor. If the weight fraction is more than 45 wt %, then the touch of the obtained fiber tends to be poor, and the spinnability also tends to be poor. Furthermore, if the viscosity average degree of polymerization of constituents that are soluble in tetrahydrofuran is less than 500, then the matting effects tend to be insufficient, and the style changeability also tends to be poor. If the viscosity average degree of polymerization is more than 1800, then the melt viscosity becomes high, and thus performing stable operation in the spinning process tends to be difficult.

The crosslinked vinyl chloride resin used in the present invention easily can be obtained by performing polymerization while adding a polyfunctional monomer, during suspension polymerization, microsuspension polymerization, or emulsion polymerization of vinyl chloride in an aqueous medium. Particularly preferable examples of the polyfunctional monomer used at that time include diacrylate compounds such as polyethylene glycol diacrylate and bisphenol A-modified diacrylate. This resin has a crosslinked structure, and is a mixture of gels mainly constituted by vinyl chloride insoluble in tetrahydrofuran, and polyvinyl chloride constituents soluble in tetrahydrofuran.

The weight fraction of constituents that are insoluble in tetrahydrofuran (gel fraction) is measured in the following manner. First, 1 g of crosslinked vinyl chloride resin is added to 60 ml of tetrahydrofuran, and the mixture is allowed to stand for approximately 24 hours. Then, the resin is dissolved sufficiently using an ultrasonic cleaner. Insoluble matters in the tetrahydrofuran solution are separated using an ultracentrifuge (30000 rpm×1 hour). Then, another 60 ml of tetrahydrofuran is added to the separated insoluble matters, and the resin is dissolved sufficiently using the ultrasonic cleaner. Insoluble matters in the tetrahydrofuran solution are separated using the ultracentrifuge (30000 rpm×1 hour), and dried. The gel fraction is calculated by the following formula.

$$\text{Gel fraction}(\%)=\text{weight of the insoluble matters}(g)/1g\times 100$$

The crosslinked vinyl chloride resin is added, preferably in an amount of 0.2 to 20 parts by weight, and more preferably in an amount of 1 to 5 parts by weight, with respect to 100 parts by weight of the vinyl chloride resin. If the amount is less than 0.2 parts by weight, then the matte properties and the style changeability of the obtained fiber are lowered, so that such an amount is not preferable. Furthermore, if the amount is more than 20 parts by weight, then the spinnability and the touch of the obtained fiber are lowered, so that such an amount is not preferable During production of the vinyl chloride resin composition of the present invention, a thermal stabilizer and a lubricant may be added as appropriate. As the thermal stabilizer used in the present invention, conventionally known thermal stabilizers can be used. Of these, it is preferable to use at least one type of thermal stabilizer selected from the group consisting of tin-based thermal stabilizers, Ca—Zn-based thermal stabilizers, hydrotalcite-based thermal stabilizers, epoxy-based thermal stabilizers, and β-diketone-based thermal stabilizers. The thermal stabilizer is used preferably in an amount of 0.2 to 5 parts by weight and more preferably in an amount of 1 to 3 parts by weight. If the amount is less than 0.2 parts by weight, then the effect as the thermal stabilizers is poor. Even if the amount is more than 5 parts by weight, the thermal stability is not significantly increased, and thus it is disadvantageous economically.

When the thermal stabilizer is added, thermal decomposition of the resin during spinning is prevented, and thus an effect of preventing degradation of hues of the fiber, an effect of enabling spinning to be performed stably (long-run spinnability), and other effects are exerted. The long-run spinnability refers to properties with which fibers can be produced by continuing the operation for several days stably without stopping the spinning process. When a resin composition having low long-run spinnability is used, within a comparatively short time after starting the operation, a yarn starts to be broken, for example, due to plate out, or die pressure starts to increase. Accordingly, it is necessary to replace breaker plates or nozzles, and then re-start the operation, and thus the production efficiency is poor. The degradation of hues of the fiber described above refers to initial coloring of the fiber during spinning.

Of the thermal stabilizers, examples of the tin-based thermal stabilizers include: mercaptotin-based thermal stabilizers such as dimethyltin mercapto, dimethyltin mercaptide, dibutyltin mercapto, dioctyltin mercapto, dioctyltin mercapto polymer, and dioctyltin mercapto acetate; maleatetin-based thermal stabilizers such as dimethyltin maleate, dibutyltin maleate, dioctyltin maleate, and dioctyltin maleate polymer; and lauratetin-based thermal stabilizers such as dimethyltin laurate, dibutyltin laurate, and dioctyltin laurate. Examples of the Ca—Zn-based thermal stabilizers include zinc stearate, calcium stearate, zinc 12-hydroxystearate, and calcium 12-hydroxystearate. Examples of the hydrotalcite-based thermal stabilizers include ALCAMIZER manufactured by Kyowa Chemical Industry Co., Ltd. Examples of the epoxy-based thermal stabilizers include epoxidized soybean oil and epoxidized linseed oil. Examples of the β-diketone-based thermal stabilizers include stearoylbenzoylmethane (SBM) and dibenzoylmethane (DBM).

As the lubricant used in the present invention, conventionally known lubricants can be used. Of these, it is particularly preferable to use at least one type of lubricant selected from the group consisting of metal soap-based lubricants, polyethylene-based lubricants, higher fatty acid-based lubricants, ester-based lubricants, and higher alcohol-based lubricants. The lubricant is effective for controlling a molten state of the composition, and a bonded state of the composition and a metal face such as screws, cylinders, or dies in an extruder. The lubricant is added preferably in an amount of 0.2 to 5.0 parts by weight with respect to 100 parts by weight of the vinyl chloride resin. The lubricant is added more preferably in an amount of 1 to 4 parts by weight. If the amount is less than 0.2 parts by weight, then the production efficiency is lowered because the die pressure is increased and the ejection amount is lowered during spinning. Moreover, yarns tend to be broken more often, and the nozzle pressure tends to be increased more often, so that performing stable production becomes difficult. If the amount is more than 5 parts by weight, then the ejection amount is lowered and yarns frequently are broken, for example, and thus performing stable production becomes difficult as in the case where the amount is less than 0.2 parts by weight. Moreover, the fiber tends not to be clear, so that such an amount is not preferable.

Examples of the metal soap-based lubricants include metal soaps such as stearate, laurate, palmitate, and oleate of Na, Mg, Al, Ca, and Ba. Examples of the higher fatty acid-based lubricants include: saturated fatty acids such as stearic acid, palmitic acid, myristic acid, lauric acid, and capric acid; unsaturated fatty acids such as oleic acid; and their mixtures. Examples of the higher alcohol-based lubricants include stearyl alcohol, palmityl alcohol, myristyl alcohol, lauryl alcohol, and oleyl alcohol. Examples of the ester-based lubricants include: ester-based lubricant comprising alcohol and a fatty acid; pentaerythritol-based lubricants such as monoester, diester, triester, tetraester, or their mixtures comprising pentaerythritol or dipentaerythritol, and a higher fatty acid; montanoic acid wax-based lubricants such as esters comprising a montanoic acid, and higher alcohol such as stearyl alcohol, palmityl alcohol, myristyl alcohol, lauryl alcohol, and oleyl alcohol.

During production of the polyvinyl chloride-based fiber of the present invention, for example, a processing aid, a matting agent, a filler, a plasticizer, an ultraviolet absorber, an antioxidant, an antistatic agent, a flame retardant, and a pigment may be used according to the purpose.

Of these, as disclosed in Patent Document 1, more preferably added are an ethylene/vinyl acetate (EVA) resin (e.g., PES-250 manufactured by Nippon Unicar Company Limited) for further improving the quality, more specifically, for obtaining soft touch, and an acrylic resin (e.g., PA-20 manufactured by KANEKA CORPORATION) for further improving extrudability.

Figure 2:
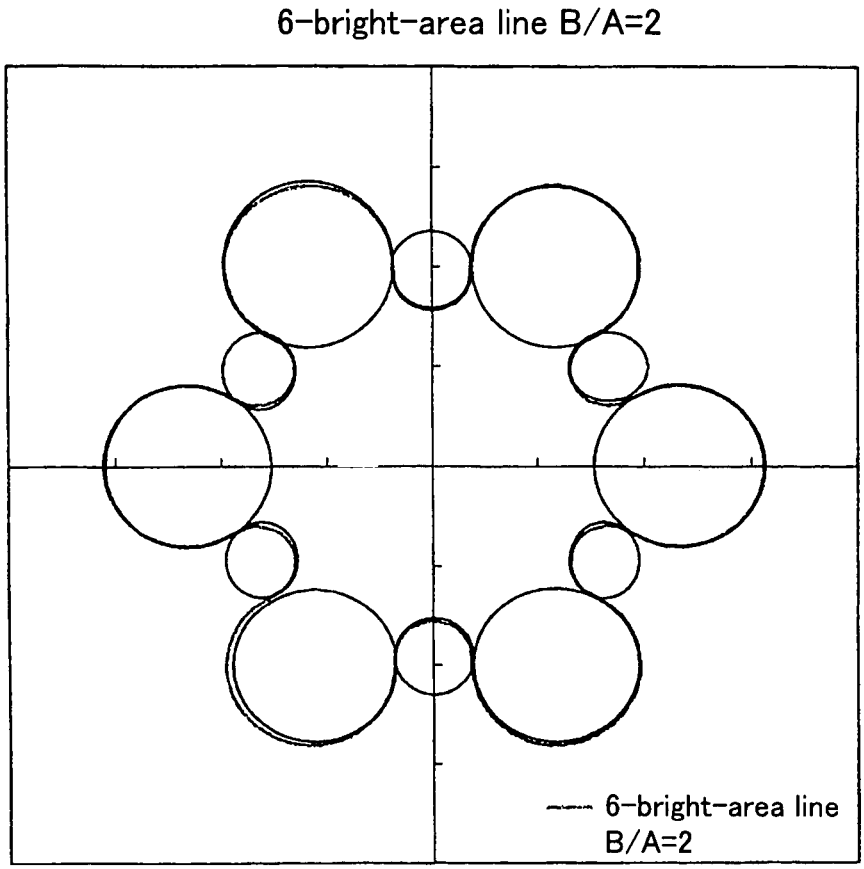
FIG. 2 is a cross-sectional view with a six-leaved cross section (constituted by 12 circles).

In order to exert the effect of the present invention, it is necessary for the polyvinyl chloride-based fiber of the present invention to have a cross-sectional shape constituted by a combination of two or more of circles, ellipses, and parabolas. Representative examples of the cross-sectional shape include the shape of a star having five projecting portions (five-leaved cross-section) or six projecting portions (six-leaved cross section) as shown in FIG. 1. In the present invention, a cross section having N projecting portions is also referred to as an N-leaved cross section. For example, a six-leaved cross section refers to a cross-sectional shape constituted by a combination of six large circles and six small circles as shown in FIG. 2. In the cross-sectional shape in FIG. 2, the six large circles and the six small circles respectively have the same radiuses and symmetrical shapes, but the radiuses need not be the same. It would be appreciated that one of the six projecting portions on the six-leaved cross section may be in the shape of an ellipse or a parabola, or that circles, ellipses, and parabolas may be used in combination.

It is necessary that the projecting portion on the fiber cross section has a certain level of size. The area of the projecting portion on the cross section calculated in the following manner is preferably 1/20 or more, more preferably 1/10 or more, and particularly preferably 1/5 or more, with respect to the area of the largest inscribed circle of the cross section. Furthermore, on the fiber cross section, the number of the projecting portions having such an area is preferably 2 or more, more preferably 3 or more, and particularly preferably 4 or more. The number is most preferably 5 to 8.

(Area Calculating Method)

On the fiber cross section, the area of a portion enclosed by a straight line connecting two local minimum points on both sides of the projecting portion, and a curved line forming the projecting portion, is taken as the area of the projecting portion. It should be noted that a portion with an area of less than 1/20 of the area of an inscribed circle is not taken as a projecting portion.

Figure 3:
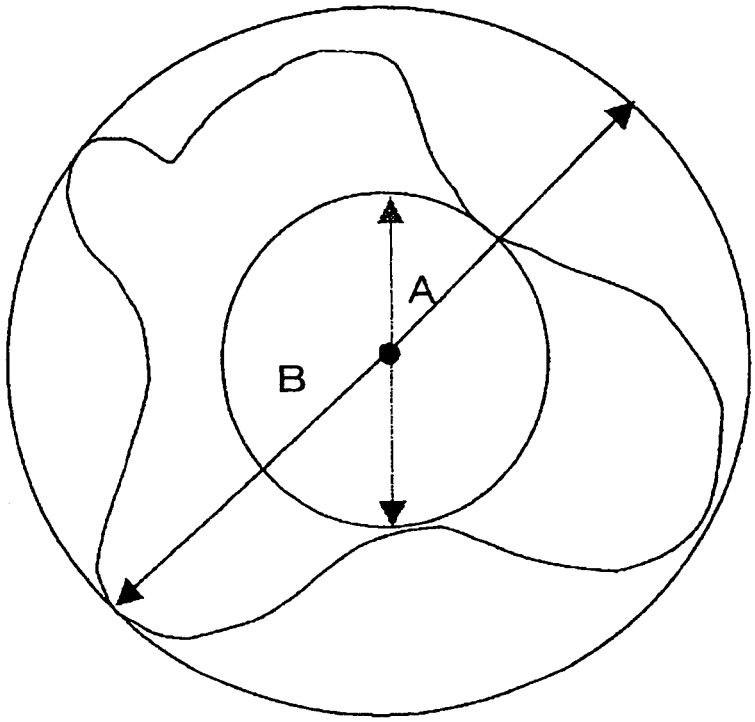
FIG. 3 shows a minor diameter (A) and a major diameter (B) of an asymmetrical cross section.

In the present invention, a minor diameter A of the cross-sectional shape refers to the diameter of an inscribed circle of the cross-sectional shape, and a major diameter B refers to the diameter of a circumscribed circle of the cross-sectional shape, as shown in FIG. 1. Furthermore, in the case of an asymmetrical cross-sectional shape as shown in FIG. 3, the diameter of the largest inscribed circle is taken as A, and the diameter of the smallest circumscribed circle is taken as B. In view of style changeability and matte properties, the ratio B/A preferably is 1.2 or more. In view of spinnability, touch, and style changeability, the ratio B/A preferably is 2.0 or less. Furthermore, if the ratio B/A is 1.2 to 2.0, then the style changeability is exerted even when filaments with some types of cross-sectionals shapes, such as ten filaments with five-leaved cross sections and ten filaments with six-leaved cross sections, are mixed. Furthermore, in the case of an asymmetrical cross-sectional shape as shown in FIG. 3, when the diameter of the smallest circumscribed circle is taken as B, the center of this circle is taken as P, and the diameter of an inscribed circle centered about P is taken as A as shown in FIG. 3, the ratio B/A more preferably is 1.2 to 2.0.

Furthermore, the polyvinyl chloride-based fiber of the present invention preferably has projections (protrusions) on surface at random, and an average longitudinal length of the projections preferably is 1 to 30 μm. If the average longitudinal length of the projections is less than 1 μm, then the style changeability is lowered. If the average longitudinal length is more than 30 μm, then the touch is degraded. The projections on the fiber surface tend to be large if the fraction of gels insoluble in tetrahydrofuran is high in the crosslinked vinyl chloride resin. Projections obtained in ordinary melt-spinning are in most cases in the shape of circular cones formed by smooth curved lines (in rare cases, partially in the shape of pyramids), and have a height of 30 μm or less in most cases.

The polyvinyl chloride-based fiber of the present invention can be produced by a known melt-spinning method. For example, a vinyl chloride resin (a), a crosslinked vinyl chloride resin (b), a thermal stabilizer, and a lubricant are mixed in a predetermined ratio, and agitated and mixed using a Henschel mixer and the like, and then an extruder is filled with the mixture. This resin is melt extruded under conditions providing good spinnability at a cylinder temperature of 150 to 190° C. and a nozzle temperature of 180±15° C.

The extruded filaments are subjected to thermal treatment for approximately 0.5 to 1.5 seconds within a heat-spinning tube (200 to 300° C. atmosphere, conditions providing good spinnability) provided directly under the nozzle. Then, the produced undrawn yarns are sent by a take-in roll so as to be subjected to a drawing process. Next, the undrawn yarns are drawn to three times between the take-in roll and a drawing roll through a hot air circulation chamber in which the temperature has been adjusted to 110° C. Furthermore, the yarns are stretched between two pairs of circular cone rolls arranged in the hot air circulation chamber in which the temperature has been adjusted to 110 to 135° C. Relaxation treatment at approximately 25 to 40% then is performed, and multifilaments are wound, and thus the fiber of the present invention is produced.

In order to stabilize the process during production of the fiber, an oil preferably is added to the fiber. As the oil, it is possible to use a mixture of a smoothing agent, a surfactant, an antistatic agent, and the like commonly used during production of fibers. The oil preferably is added so as to be attached to the final fiber product in an oil net content of 0.1 to 0.3 wt %. If the ratio is less than 0.1 wt %, then static electricity is caused during production of the fiber, and thus performing stable production becomes difficult, so that the surface of the fiber product tends to be rough (not smooth). If the ratio is more than 0.3 wt %, then the surface of the fiber product becomes sticky, so that such a ratio is not preferable.

The vinyl chloride resin composition used in the present invention preferably is used as: a powder compound mixed using a conventionally known mixer such as a Henschel mixer, a super mixer, or a ribbon blender; or a pellet compound produced by melt-mixing this powder compound. The powder compound can be produced by either hot blending or cold blending, and ordinary conditions can be applied as the production conditions. Hot blending particularly preferably is used in which the cut temperature during blending is increased up to 105 to 155° C. in order to reduce volatile matters in the composition. The pellet compound can be produced as in production of ordinary vinyl chloride-based pellet compounds. For example, the pellet compound can be produced using a kneader such as a single screw extruder, a counter-rotating twin screw extruder, a conical twin screw extruder, a co-rotating twin screw extruder, a cokneader, a planetary gear extruder, or a roll kneader. There is no specific limitation on the condition used for production of the pellet compound, but the resin temperature preferably is set to 185° C. or lower in order to prevent the vinyl chloride resin from being deteriorated by heat. Furthermore, in order to remove foreign substances, such as a metal piece of a cleaner such as a wire brush, that may be mixed in the pellet compound, a stainless steel mesh with a small opening may be provided in the kneader. A cold cutting method can be applied for production of the pellet. It is possible to apply means for removing "chips" (fine powders generated during production of the pellet) and the like that may be mixed in during the cold cutting. However, it is preferable to use a hot cutting method in which less "chips" are mixed in.

Furthermore, a conventionally known extruder can be used for processing the vinyl chloride resin composition into fibrous undrawn yarns. For example, it is possible to use a single screw extruder, a counter-rotating twin screw extruder, or a conical twin screw extruder. It is particularly preferable to use a single screw extruder with an aperture size of approximately 35 to 85 mmϕ, or a conical extruder with an aperture size of approximately 35 to 50 mmϕ. If the aperture size is too large, then the extrusion amount becomes large, the nozzle pressure becomes too large, the rate at which the undrawn yarns flow out becomes too high, and thus winding of the yarns tends to be difficult, so that such an aperture size is not preferable.

With the thus obtained polyvinyl chloride-based fiber of the present invention, it is possible additionally to provide style changeability without impairing matte properties and touch, which are characteristics of a conventional vinyl chloride-based fiber. The reason of why a polyvinyl chloride-based fiber with these characteristics is obtained is not certain, but it seems that gels of the crosslinked vinyl chloride resin insoluble during melt-spinning emerge as projections on the fiber surface, and intertwining of yarns extremely is improved with a specific fiber cross section, and thus style changeability that has not been provided in conventional examples is present.

EXAMPLES

Hereinafter, specific embodiments of the present invention are described in more detail by way of examples, but the present invention is not limited to these examples.

(1) Evaluation of Spinnability

In a melt-spinning process, an occurrence state of yarn breaking visually was observed, and evaluated according to the following four grades.

4: yarn breaking occurred once or less/hour.

3: yarn breaking occurred 2 to 3 times/hour.

2: yarn breaking occurred 4 to 6 times/hour.

1: yarn breaking occurred 7 to 15 times/hour.

(2) Matte Properties

A bundle of fibers after melt-spinning was observed, and evaluated according to the following four grades. When judging matte properties, a vinyl chloride-based fiber ADVANTAGE-R manufactured by KANEKA CORPORATION was taken as Rank 3 (lusterless).

4: significantly lusterless

3: lusterless

2: comparatively lustrous

1: lustrous (3) Touch

A bundle of fibers after melt-spinning was touched for judgment, and evaluated according to the following four grades. When judging touch, a vinyl chloride-based fiber ADVANTAGE-R manufactured by KANEKA CORPORATION was taken as Rank 4 (very soft and flexible).

4: very soft and flexible

3: soft and flexible

2: comparatively hard

1: very hard (4) style changeability

Figure 4:
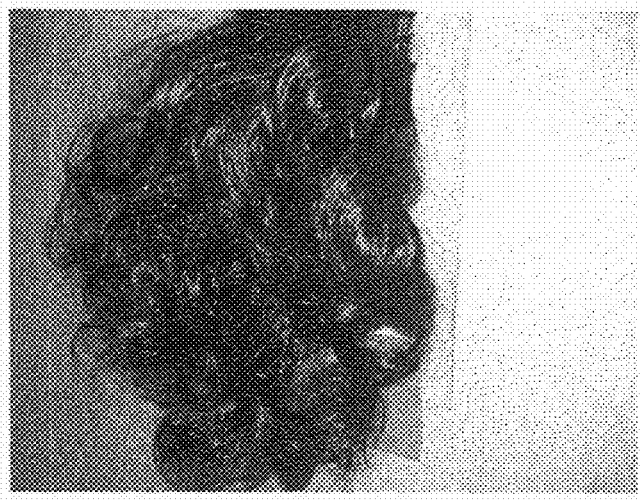
FIG. 4 is a photograph of a style (A) in evaluation of style changeability.
Figure 5:
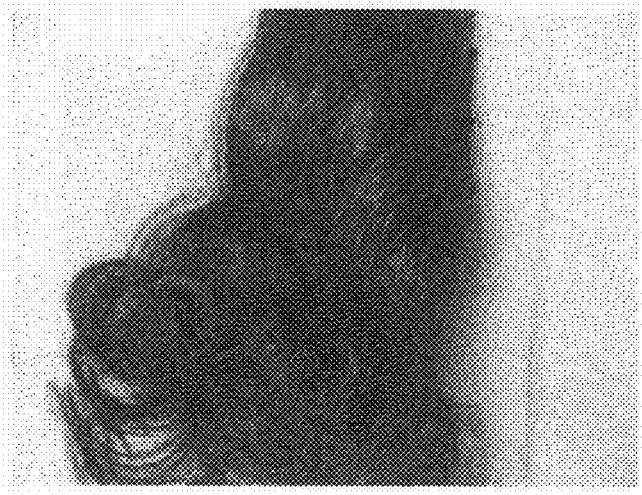
FIG. 5 is a photograph of a style (B) in evaluation of style changeability.
Figure 6:
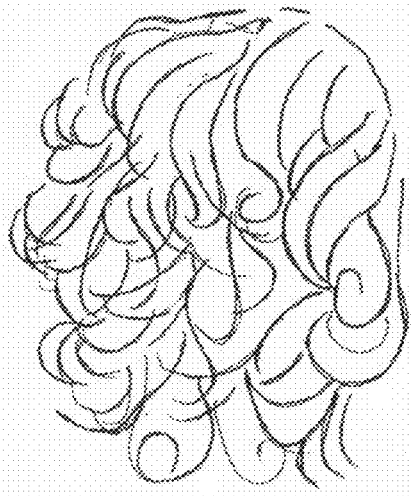
FIG. 6 is a schematic view of the style (A).
Figure 7:
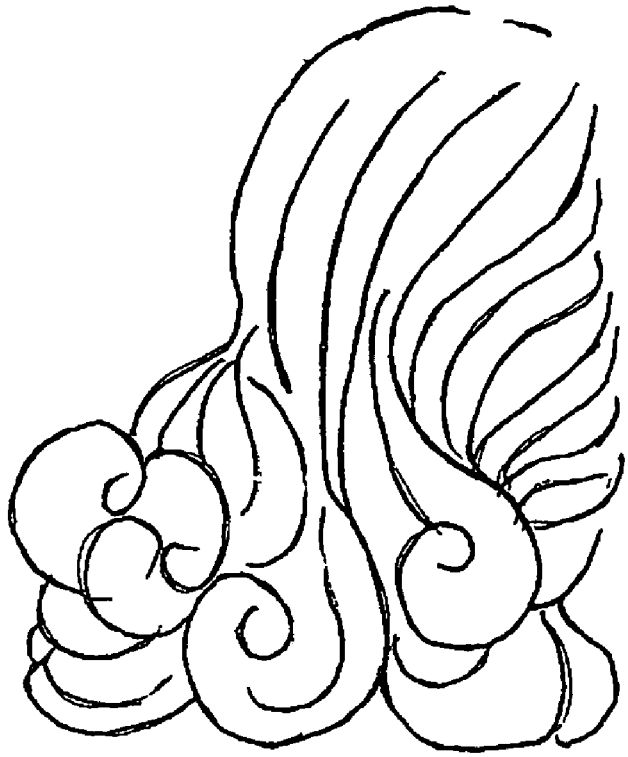
FIG. 7 is a schematic view of the style (B).

In the following manner, a simple wig for evaluation was produced and evaluated. The obtained fibers are cut into length of 25 cm, 2 g of the cut fibers uniformly are spread in a width of 10 cm in a straight line, and the fibers are sewed on cloth or the like using a sewing machine. Ten such groups of fibers were produced and arranged spaced apart from each other by 1 cm in the vertical direction, and thus a wig for evaluation was obtained. This wig was wound around a metal pipe having a diameter of 32 mm, and the wig was curled by being set for one hour in a drier in which the temperature had been adjusted to 95° C. Easiness in setting style was evaluated according to the following four grades, when changing the style (A) shown in FIG. 4 into the style (B) shown in FIG. 5 by brushing the wig.

4: brushing twice or less is sufficient for changing the style (A) into the style (B), that is, the style can be set very easily.

3: brushing 3 to 5 times is sufficient for changing the style (A) into the style (B), that is, the style can be set easily.

2: brushing 6 times or more is necessary for changing the style (A) into the style (B).

1: however many times brushing is performed, the style (A) cannot be changed into the style (B).

(5) Major Diameter and Minor Diameter on a Cross-Sectional Shape

The diameters of a cross-sectional shape were measured by cutting cross sections with a cutter or the like, observing ten cross sections with a SEM at a magnification of 300 times, measuring the major diameter B and the minor diameter A on each cross section, and calculating average values of the ten cross sections.

(6) Length of Projections on a Fiber Surface

A fiber surface was observed with a SEM at a magnification of 1000 times, ten projections were selected, the longitudinal lengths of the projections were measured, and an average value of the ten projections was calculated.

Examples 1 to 9 and Comparative Examples 1 to 5

Vinyl chloride resins, partially crosslinked vinyl chloride resins, stabilizers, lubricants, and additives in predetermined ratios listed in Table 1 below were agitated and mixed using a Henschel mixer, and thus compounds were produced. It should be noted that PES-250 manufactured by Nippon Unicar Company Limited was used as an EVA resin, and that PA-20 manufactured by KANEKA CORPORATION was used as a processing aid. In addition to the substances listed in Table 1, 0.5 parts by weight of EW-100 manufactured by Riken Vitamin Co., Ltd. and 0.5 parts by weight of HW400P manufactured by Mitsui Chemicals, Inc. were added as lubricants in all of the examples and the comparative examples. A nozzle was attached to an extruder with a diameter of 30 mm, the nozzle having 120 openings with a cross section of 0.1 $mm^2$. The compounds were melt extruded under conditions providing good spinnability at a cylinder temperature of 140 to 190° C. and a nozzle temperature of 180±15° C. The extruded filaments were subjected to thermal treatment for approximately 0.5 to 1.5 seconds within a heat-spinning tube (200 to 300° C. atmosphere, conditions providing good spinnability) provided directly under the nozzle. The produced undrawn yarns were sent by a take-in roll so as to be subjected to a drawing process. Immediately before the take-in roll, an oil was added to the undrawn yarns such that the weight fraction of an oil net content was 0.2 wt % with respect to the weight of the final product. Next, the undrawn yarns were drawn to three times between the take-in roll and a drawing roll through a hot air circulation chamber at 110° C. Furthermore, the yarns were stretched between two pairs of circular cone rolls arranged in the chamber in which the temperature had been adjusted to 110° C. Relaxation treatment at 35% then was performed, and multifilaments at a single yarn fineness of 70 decitex were wound. The processability (spinnability) at that time and the properties of the obtained multifilaments were evaluated by the above-described methods, and the results are shown in Table 1.

TABLE 1

| | | | | Ex. 1 | Ex. 2 | Ex. 3 | Ex. 4 | Ex. 5 | Ex. 6 | Ex. 7 |
|---|---|---|---|---|---|---|---|---|---|---|
| resin | PVC resin | PVC | | 87 | 87 | 87 | 87 | 87 | 87 | 87 |
| pro- | | CPVC | | 13 | 13 | 13 | 13 | 13 | 13 | 13 |
| portion | | partially | (1) | 3 | | 0.5 | 20 | 3 | 3 | 3 |
| | | crosslinked | (2) | | 3 | | | | | |
| | | PVC | (3) | | | | | | | |
| | | | (4) | | | | | | | |
| | stabilizer | stabilizer (1) | | 1 | 1 | 1 | 1 | | 1 | 1 |
| | | stabilizer (2) | | 0.5 | 0.5 | 0.5 | 0.5 | | 0.5 | 0.5 |
| | | stabilizer (3) | | | | | | 1.5 | | |
| | | stabilizer (4) | | | | | | 0.8 | | |
| | lubricant | lubricant (1) | | 1 | 1 | 1 | 1 | | 1 | 1 |
| | | lubricant (2) | | 1.4 | 1.4 | 1.4 | 1.4 | | 1.4 | 1.4 |
| | | lubricant (3) | | | | | | 0.6 | | |
| | | lubricant (4) | | | | | | 0.6 | | |
| | additive | EVA resin | | 13 | 13 | 13 | 13 | 13 | 13 | 13 |
| | | processing aid | | 1 | 1 | 1 | 1 | 1 | 1 | 1 |
| spinnability | | | | 4 | 4 | 4 | 3 | 4 | 4 | 3 |
| quality | matte properties | | | 4 | 4 | 4 | 4 | 4 | 3 | 4 |

TABLE 1-continued

| | | | | | | | | | | |
|---|---|---|---|---|---|---|---|---|---|---|
| | touch | | | 4 | 4 | 4 | 3 | 4 | 4 | 3 |
| | styling properties | | | 4 | 4 | 3 | 4 | 4 | 3 | 3 |
| cross | B/A ratio | | | 1.50 | 1.48 | 1.52 | 1.49 | 1.51 | 1.12 | 2.12 |
| section | cross-sectional shape | | | Six-leaved | Six-leaved | Six-leaved | Six-leaved | Six-leaved | Six-leaved | Six-leaved |
| surface projection average μm | | | | 10 | 21 | 9 | 12 | 11 | 10 | 12 |

| | | | | Ex. 8 | Ex. 9 | Com. Ex. 1 | Com. Ex. 2 | Com. Ex. 3 | Com. Ex. 4 | Com. Ex. 5 |
|---|---|---|---|---|---|---|---|---|---|---|
| resin | PVC resin | PVC | | 100 | 87 | 87 | 87 | 87 | 87 | 87 |
| pro- | | CPVC | | | 13 | 13 | 13 | 13 | 13 | 13 |
| portion | | partially | (1) | 3 | 3 | | | | | 3 |
| | | crosslinked | (2) | | | | | | 25 | |
| | | PVC | (3) | | | 3 | | | | |
| | | | (4) | | | | 3 | | | |
| | stabilizer | stabilizer (1) | | 1 | 1 | 1 | 1 | 1 | 1 | 1 |
| | | stabilizer (2) | | 0.5 | 0.5 | 0.5 | 0.5 | 0.5 | 0.5 | 0.5 |
| | | stabilizer (3) | | | | | | | | |
| | | stabilizer (4) | | | | | | | | |
| | lubricant | lubricant (1) | | 1 | 1 | 1 | 1 | 1 | 1 | 1 |
| | | lubricant (2) | | 1.4 | 1.4 | 1.4 | 1.4 | 1.4 | 1.4 | 1.4 |
| | | lubricant (3) | | | | | | | | |
| | | lubricant (4) | | | | | | | | |
| | additive | EVA resin | | 2 | 13 | 13 | 13 | 13 | 13 | 13 |
| | | processing aid | | 0.2 | 1 | 1 | 1 | 1 | 1 | 1 |
| spinnability | | | | 4 | 4 | 4 | 2 | 4 | 2 | 4 |
| quality | matte properties | | | 3 | 4 | 2 | 4 | 2 | 4 | 2 |
| | touch | | | 3 | 4 | 4 | 2 | 4 | 1 | 3 |
| | styling properties | | | 3 | 4 | 2 | 4 | 1 | 4 | 2 |
| cross | B/A ratio | | | 1.51 | 1.52 | 1.51 | 1.52 | 1.53 | 1.50 | 1 |
| section | cross-sectional shape | | | Six-leaved | Five-leaved | Six-leaved | Six-leaved | Six-leaved | Six-leaved | circle |
| surface projection average μm | | | | 9 | 10 | 0.9 | 35 | 0 | 10 | 11 |

PVC: degree of polymerization 1000
chlorinated vinyl chloride (CPVC): degree of polymerization 800, degree of chlorination 64%
partially crosslinked vinyl chloride: (1) gel fraction 22%, degree of polymerization 1000, (2) gel fraction 43%, degree of polymerization 1000 (3) gel fraction 15%, degree of polymerization 760, (4) gel fraction 48%, degree of polymerization 1300
stabilizer: (1) butyltin mercapto stabilizer, (2) butyltin maleate stabilizer, (3) hydrotalcite, (4) dibenzoylmethane
lubricant: (1) calcium stearate, (2) magnesium stearate, (3) calcium 12-hydroxystearate, (4) magnesium 12-hydroxystearate In Comparative Example 1, a fiber was produced as in Example 1, except that another type of partially crosslinked vinyl chloride was used. It is shown that if the gel fraction of the crosslinked vinyl chloride is lower than 18% in this manner, then surface projections are small, and thus the style changeability significantly is lowered, and the matte properties also are lowered.

In Comparative Example 2, a fiber was produced as in Example 1, except that another type of partially crosslinked vinyl chloride was used. It is shown that if the gel fraction of the crosslinked vinyl chloride is higher than 45%, then surface projections are larger, and thus the spinnability and the touch are degraded, so that this fiber is not preferable.

In Comparative Example 3, a fiber was produced as in Example 1, except that no partially crosslinked vinyl chloride was added. In this case, the matte properties and the style changeability significantly are poor as in Comparative Example 1.

In Comparative Example 4, a fiber was produced as in Example 1, except that 25 parts of partially crosslinked vinyl chloride was added. In this case, the spinnability and the touch are poor, so that this fiber is not preferable.

In Comparative Example 5, a fiber was produced as in Example 1, except that the cross-sectional shape is circular. In this case, the matte properties and the style changeability tend to be poor.

The results in Table 1 show that a polyvinyl chloride-based fiber, comprising a vinyl chloride resin composition that comprises (a) 100 parts by weight of vinyl chloride resin, and (b) 0.2 to 20 parts by weight of crosslinked vinyl chloride resin in which the weight fraction of constituents that are insoluble in tetrahydrofuran is 18 to 45% and the viscosity average degree of polymerization of constituents that are soluble in tetrahydrofuran is 500 to 1800, wherein a cross-sectional shape of the fiber comprises a combination of two or more of circles, ellipses, and parabolas, has excellent style changeability while keeping matte properties, touch, and other characteristics of a conventional vinyl chloride-based fiber.

INDUSTRIAL APPLICABILITY

When the fiber of the present invention having a specific cross-sectional shape is used as artificial hair, it is possible to provide style changeability without impairing matte properties and touch of the vinyl chloride-based fiber. Furthermore, the fiber of the present invention can be produced stably by melt-spinning, and thus an industrial advantage also is provided.

The invention claimed is:

1. A polyvinyl chloride-based fiber, comprising a vinyl chloride resin composition that comprises;

(a) 100 parts by weight of vinyl chloride resin; and, (b) 0.2 to 20 parts by weight of crosslinked vinyl chloride resin in which a weight fraction of constituents that are insoluble in tetrahydrofuran is 18 to 45% and a viscosity average degree of polymerization of constituents that are soluble in tetrahydrofuran is 500 to 1800, wherein a cross-sectional shape of the fiber comprises a combination of at least two circles.

2. The polyvinyl chloride-based fiber according to claim 1, wherein the cross-sectional shape of the fiber comprises a combination of at least three circles.

3. The polyvinyl chloride-based fiber according to claim 1, wherein the cross-sectional shape of the fiber comprises a combination of at least four circles.

4. The polyvinyl chloride-based fiber according to claim 1, wherein ratio B/A between a minor diameter (A) and a major diameter (B) of a cross-sectional shape of the fiber is 1.2 to 2.0.

5. The polyvinyl chloride-based fiber according to claim 1, wherein the surface of the fiber further has protrusions, and an average longitudinal length of the protrusions is 1 μm to 30 μm.

6. The polyvinyl chloride-based fiber according to claim 1, wherein the cross-sectional shape of the fiber comprises the combination and further an ellipse or a parabola.

7. The polyvinyl chloride-based fiber according to claim 1, wherein the cross-sectional shape of the fiber is the shape of a star having five or six projecting portions.

8. The polyvinyl chloride-based fiber according to claim 1, wherein an area of the projecting portion of the cross section of the fiber is 1/20 or more with respect to an area of the largest inscribed circle of the cross section, the area of the projecting portion being an area of a portion enclosed by a straight line connecting two local minimum points on both sides of the projecting portion, and a curved line forming the projecting portion.

9. The polyvinyl chloride-based fiber according to claim 1, wherein the vinyl chloride resin (a) is a homopolymer resin that is vinyl chloride homopolymer, or a copolymer resin containing vinyl chloride.

10. The polyvinyl chloride-based fiber according to claim 9, wherein the copolymer resin is at least one type of copolymer selected from the group consisting of a vinyl chloride/vinyl acetate copolymer resin, a vinyl chloride/vinyl propionate copolymer resin, a vinyl chloride/butyl acrylate copolymer resin, a vinyl chloride/2-ethylhexyl acrylate copolymer resin, a vinyl chloride/ethylene copolymer resin, a vinyl chloride/propylene copolymer resin, and a vinyl chloride/acrylonitrile copolymer resin.

11. The polyvinyl chloride-based fiber according to claim 1, wherein a chlorinated vinyl chloride resin is mixed in a ratio of 0 to 40 wt % with respect to 100 to 60 wt % of the vinyl chloride resin.

12. The polyvinyl chloride-based fiber according to claim 1, wherein the vinyl chloride resin is a chlorinated vinyl chloride resin having a chlorine content of 58 to 72%.

13. The polyvinyl chloride-based fiber according to claim 1, wherein at least one type of thermal stabilizer selected from the group consisting of a tin-based thermal stabilizer, a Ca—Zn-based thermal stabilizer, a hydrotalcite-based thermal stabilizer, an epoxy-based thermal stabilizer, and a β-diketone-based thermal stabilizer is added to the vinyl chloride resin composition.

14. The polyvinyl chloride-based fiber according to claim 13, wherein the thermal stabilizer is added in an amount of 0.2 to 5 parts by weight to the vinyl chloride resin composition.

15. The polyvinyl chloride-based fiber according to claim 1, wherein at least one type of lubricant selected from the group consisting of a metal soap-based lubricant, a polyethylene-based lubricant, a higher fatty acid-based lubricant, an ester-based lubricant, and a higher alcohol-based lubricant is added to the vinyl chloride resin composition.

16. The polyvinyl chloride-based fiber according to claim 15, wherein the lubricant is added in an amount of 0.2 to 5.0 parts by weight to the vinyl chloride resin composition.

17. The polyvinyl chloride-based fiber according to claim 1, wherein an ethylene/vinyl acetate (EVA) resin is added to the vinyl chloride resin composition.

18. The polyvinyl chloride-based fiber according to claim 1, wherein an acrylic resin is added to the vinyl chloride resin composition.

19. The polyvinyl chloride-based fiber according to claim 1, wherein a viscosity average degree of polymerization of the vinyl chloride resin is at least 450 and at most 1800.

20. The polyvinyl chloride-based fiber according to claim 1, wherein the polyvinyl chloride-based fiber is a fiber for artificial hair.

* * * * *